US006537042B1

(12) United States Patent
Lundbäck

(10) Patent No.: US 6,537,042 B1
(45) Date of Patent: Mar. 25, 2003

(54) POSITIVE-DISPLACEMENT PUMP

(75) Inventor: Stig Lundbäck, Vaxholm (SE)

(73) Assignee: Ectacor AB, Stockholm (SE)

( * ) Notice: Subject to any disclaimer, the term of this patent is extended or adjusted under 35 U.S.C. 154(b) by 0 days.

(21) Appl. No.: 09/914,347

(22) PCT Filed: Feb. 25, 2000

(86) PCT No.: PCT/SE00/00378

§ 371 (c)(1),
(2), (4) Date: Aug. 27, 2001

(87) PCT Pub. No.: WO00/50774

PCT Pub. Date: Aug. 31, 2000

(30) Foreign Application Priority Data

Feb. 25, 1999 (SE) ..... 9900676

(51) Int. Cl.[7] ..... F04B 39/10
(52) U.S. Cl. ..... 417/547; 417/554; 417/555.2
(58) Field of Search ..... 417/546, 547, 417/554, 555.2, 497

(56) References Cited

U.S. PATENT DOCUMENTS 3,175,512 A * 3/1965 Sutliff ..... 417/555.2
3,479,958 A * 11/1969 Anderson et al. ..... 417/555.2
4,662,831 A * 5/1987 Bennett ..... 417/430

FOREIGN PATENT DOCUMENTS

FR 2615910 A1 12/1988
FR 2633672 A1 1/1990
SE 456686 B 10/1988

* cited by examiner

*Primary Examiner*—Charles G. Freay
(74) *Attorney, Agent, or Firm*—Browdy and Neimark

(57) ABSTRACT

A positive-displacement pump (lifting pump) comprises a pump housing with a pump chamber having an inlet and an outlet passage controlled by an outlet check valve; a displacement member which delimits the pump chamber in one direction of movement of the displacement member and which is reciprocable in the pump chamber within a stroke region and includes a second check valve opening into the pump chamber within a stroke region and includes a second check valve opening into the pump chamber and disposed in a passage between the inlet and the pump chamber; and an actuating mechanism for repetitively reciprocating the displacement member in the pump housing within the stoke region. The displacement member has an upper thrust surface, which is constantly subjected to the pressure in the outlet passage during the movement of the displacement member within the stroke region, and a corresponding lower thrust surface, which is constantly subjected to the pressure in the inlet during the movement of the displacement member within the stroke region, so that the displacement member is subjected to a resulting vertical thrust force when the pressures in the inlet and the outlet are dissimilar. The pump chamber is limited in the opposite direction of movement of the displacement member by and end part, which is in engagement with the pump housing and drivable away from the pump housing by means of the displacement member upon movement of the displacement member beyond the stroke region.

10 Claims, 2 Drawing Sheets

POSITIVE-DISPLACEMENT PUMP

The present application is the national stage under 35 U.S.C. 371 of international application PCT/IL99/00112, filed Feb. 24, 1999 which designated the United States, and which international application was published under PCT Article 21(2) in the English language.

This invention relates to a positive-displacement pump, namely to a piston pump of the type that is often used to pump liquid, such as water or oil, from a well by lifting or pushing up a liquid column accommodated in a delivery conduit and resting on the pump piston. Pumps of that type are often called lifting pumps.

More particularly, the invention relates to a positive-displacement pump of the kind defined in the precharacterising part of the independent claim.

At the lower end, in or beneath the pump chamber, that is, beneath the region within which the displacement member, the pump piston, moves up and down during the pumping operation, the classic lifting pumps have a stationary inlet valve in the form of a check valve which opens from the inlet into the pump chamber and an outlet valve carried by the pump piston, the outlet valve being a check valve which opens from the pump chamber into the delivery conduit.

In a variant of these pumps the pump piston carries the inlet valve and the outlet valve is placed at the top of the pump chamber or above it. An example of a lifting pump representing this variant is disclosed in WO90/08898.

The lifting member of the actuating mechanism may be a purely tensile member, i.e. a cable or some other flexible element which is essentially only capable of transmitting tensile forces and can therefore only effect the upward movement of the pump piston and limit the downward movement thereof. In such a case, the downward movement of the pump piston may be produced by the piston itself by virtue of its having a great weight and/or its being weighted to overcome the piston friction and the force required to open the valve. However, the lifting member may also be a rod or other stiff element that can also transmit compression forces to push down the pump piston.

The invention relates to a pump that can be categorised as being of the abovementioned variant and is improved in various respects over the prior art pumps. These improvements are achieved through the features set forth in the claims.

The pump according to the invention can be designed so as to be simple structurally and in production and thereby reliable and inexpensive. Although it is not so limited, it is therefore particularly suited for use as a well pump for pumping water in geographical regions where an inexpensive and easy-to-use and easy-to-install well pump is required in order that the population may have local access to well water.

The available cross-sectional area in the delivery conduit can be utilised to a large extent, meaning that the cross-sectional area of the pump piston can be a large percentage of the cross-sectional area of the delivery conduit. Even if the diameters of the wellbore and the delivery conduit are small, each pump stroke can yield a sufficiently large delivery volume without the stroke length having to be excessive.

Moreover, in the pump according to the invention, the pressure within the liquid column accommodated in the delivery conduit above the pump chamber can be utilised to bring about the downward movement of the pump piston or, more accurately, to add to the normally quite insufficient downward force resulting from the weight of the piston. A sufficient downward force can therefore be achieved without adding weight to the piston, even where the lifting member is a cable.

This effect is achieved because the displacement member is hydrostatically inbalanced such that it has an upper, i.e. upwardly facing thrust surface, which is always situated upstream of the displacement member during the movement of the displacement member and therefore constantly subjected to the pressure existing in the outlet (the delivery conduit), and a corresponding downwardly facing lower thrust surface, which is always situated in the inlet during the movement of the displacement member and thereby constantly subjected to the pressure existing in the inlet. During the pumping, the liquid column in the delivery conduit constantly causes the pressure in the outlet to be substantially greater than the pressure in the inlet, and because of the pressure differential that is thus always present between the outlet and the inlet, i.e. between the upper thrust surface and the lower thrust surface, the displacement member will constantly be subjected to a downward hydrostatic force, the magnitude of which is proportional to the pressure differential and the surface area of the net thrust surface.

Moreover, the pump piston and the inlet and outlet valves can readily be extracted as a unit to the ground level for inspection or maintenance, such as replacement of seals, and then reintroduced into the well. This operation does not require the delivery conduit to be extracted.

The delivery conduit can be a plastic hose which can easily be inserted in the well bore hole and extracted again when required. The hose can be cut on site to the length appropriate in each case, or it can be delivered in the desired length in the form of a coil by a local supplier. On installation of the pump, the pump housing is attached to one end of the hose and the hose is then slipped into the well bore hole to the desired depth, which may be, say, 100 m or more, without jointing being necessary. If the hose is coiled, it can uncoiled successively during the insertion in the wellbore. When the hose with the pump housing is in position, the pump piston and the components associated with it are brought down to the pump housing through the hose. Alternatively, the pump piston and the components associated with it can be placed in the pump housing prior to the insertion of the hose.

The invention will be described in greater detail below with reference to the accompanying drawings, which illustrate two embodiments by way of example.

Figure 1:
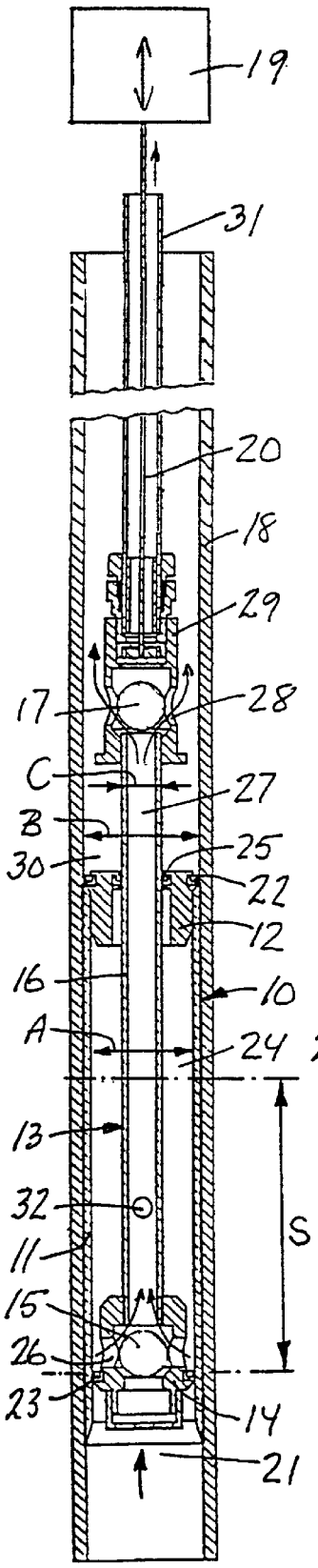
FIG. 1 is a vertical sectional view of a pump, a lifting pump, embodying the invention, the pump piston being shown in its lower end position.
Figure 2:
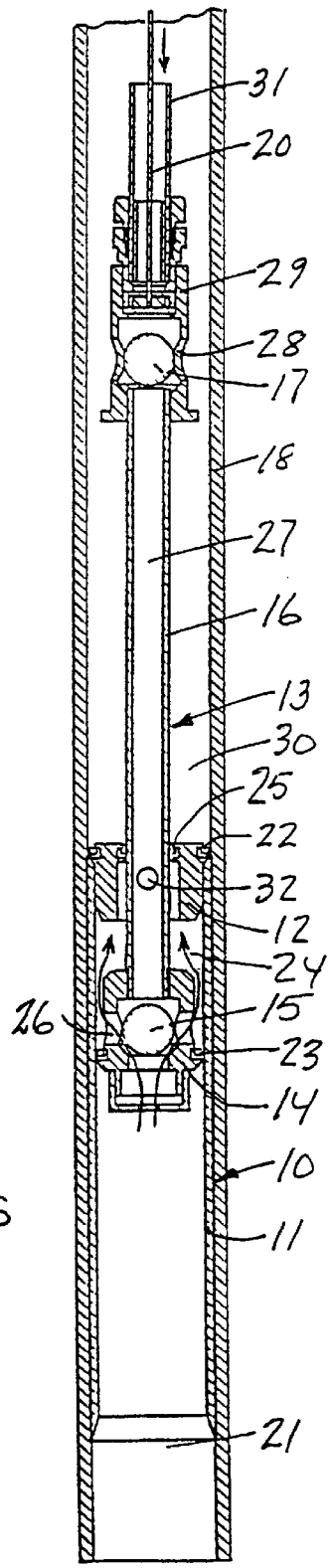
FIG. 2 is a view similar to FIG. 1 but shows the pump with the pump piston in its upper end position.
Figure 3:
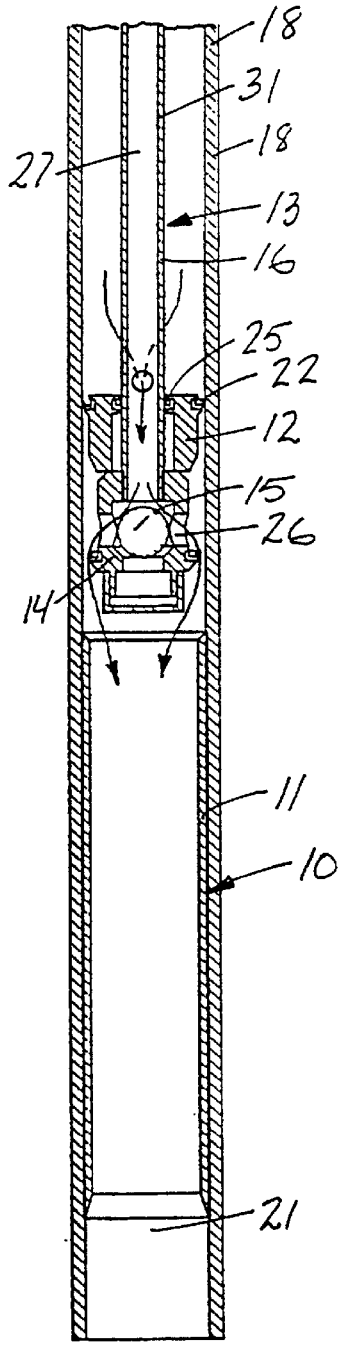
FIG. 3 is a further view similar to FIG. 1 but shows the pump piston raised to a position in which it is positioned entirely above the pump cylinder.

The pump illustrated in FIGS. 1 to 3 comprises the following main parts:

An upright tubular pump housing 10 consisting of a circular cylindrical side wall 11 and provided with an end part 12 detachably mounted on the upper end of the side wall.

A displacement member 13 which is slidable in the pump housing and comprises a pump piston 14 having an inlet valve 15 and a tubular piston rod 16 extending upwards through the end part 12 and provided with an outlet valve 17 at the upper end above the end part.

A delivery conduit 18 consisting of a rigid tube or a hose and enclosing the pump housing 10 and the displacement member 13.

An actuating mechanism 19 not shown in detail which is positioned at the upper end of the delivery conduit and connected to the piston rod 16 of the displacement member 13 through the intermediary of a lifting cable; the actuating mechanism may be a manually or power-driven actuating mechanism and operates repetitively to raise the displacement member 13 from a lower position to an upper position and allow it to return to the lower position, so that the pump piston 14 moves through a stroke range designated by S in FIG. 1.

The pump housing 10 is secured inside the delivery conduit 18 slightly above the lower end of the latter by means of a shrink fit between the outer side of the pump housing wall 11 and the inner side of the delivery conduit. Its lower end is constantly open downwardly and together with the lowermost portion of the delivery conduit forms an inlet 21 to the pump.

The end part 12 associated with the pump housing is slid into the upper end of the pump housing wall 11 and arranged such that the outer side of the portion extending into the pump housing wall 11 sealingly engages the pump housing wall, e.g. by an O-ring (not shown) which may be disposed such that it provides a snap-action retainment of the end part 12 in the pump housing wall 11. A sealing ring 22 disposed at the portion situated higher up sealingly engages the inner side of the delivery conduit 18, the inner diameter of which is slightly larger than the inner diameter of the pump housing wall 11. Thus, the end part is only in frictional engagement with the pump housing and can be displaced upwards from the pump housing by an upward force as will be described in greater detail below. One or more connecting passages (not shown) connect the space beneath the sealing ring 22 with the inlet 21.

The pump piston 14 sealingly engages the inner side of the pump chamber wall 11 by an external sealing ring 23 to form a movable lower delimitation of a pump chamber 24 in the pump housing 10. The piston rod 16 sealingly engages an internal sealing ring 25 in the end part 12 to form an upper delimitation of the pump chamber 24.

Inlet valve 15 at the pump piston 14 is a ball check valve the valve ball of which coacts under the influence of gravity with a valve seat in the pump piston to block a passage 26 formed in the piston body between the pump chamber 24 and the inlet 21 against downward flow of liquid, i.e. flow from the pump chamber 24 into the inlet 21 whereas it allows substantially unrestricted flow of liquid in the opposite direction through the passage 26.

Outlet valve 17 also is a ball check valve which like the inlet valve 17 allows substantially free flow of liquid upwards, from the pump chamber 24 through the passage 26 in the piston rod 16 and then through a passage 28 in the valve housing 29 of the inlet valve into the space 30 in the delivery conduit 18 above the end part 12 but blocks flow of liquid in the opposite direction by the gravity coaction of the of the valve ball with a valve seat formed by the open upper end of the piston rod 16. The valve ball is inserted in the valve housing 29, which is secured to the piston rod 16 and in which the lifting cable 20 and a plastic tube 31 accommodating and protecting the cable are attached.

The choice of ball valves as inlet and outlet valves is favourable, because the ball shape of the valve bodies contributes to preventing dirt entrained in the liquid being pumped from adhering to the valves. However, the inlet and outlet valves may also advantageously be cone valves.

Slightly above the pump piston 14 the piston rod 16 is formed with a hole 32 connecting the passage 27 in the piston rod with the pump chamber 24. During normal pumping operation this hole has no function, but it is positioned such that when the displacement member 13 is drawn upwards to its highest position the hole will be above the internal sealing ring 25 in the end part 12 to connect the pump chamber 24 with the overlying space 30 in the delivery conduit 18 for a purpose to be described below.

Operation of the lifting pump in FIGS. 1 to 3 is as follows. Initially, the displacement member 13 is at the lower end position shown in FIG. 1 and the entire delivery conduit 18 and the pump chamber 24 are filled with water. Upon upward displacement of the displacement member 13 by pulling the lifting line 20 the water above the piston pump seal 23 in the pump chamber 24 will be displaced into the space 30 above the end part 12 by way of the passage 26 in the pump piston body, the passage 27 in the piston rod 16 and the passage 28 in the outlet valve 17. At the same time the space below the pump piston seal will be filled with water coming from the inlet 21.

The upward movement of the displacement member 13 takes place against the action of the hydrostatic force pressure applied to the displacement member by the column of water in the delivery conduit 18. This force acts on a surface area A which is virtually equal to the internal cross-sectional area of the pump housing wall 11; the cross-sectional area of the lifting line can be disregarded and the space inside the protective tube 31 is presumed to communicate with the surrounding space in the delivery conduit.

The head pressure in the pump chamber 24 acts upwardly o n the end part 12, but this part is also acted on by virtually the same downward pressure caused by the overlying column of water. Since that pressure acts on a surface area B which is larger th an the cross-sectional area of the pump chamber, the resulting hydrostatic force will, however, maintain the end part 12 in engagement with the upper end of the pump housing wall 11. Contributions to this engagement are provided by the weight of the end part and the friction between the seal of the end part and the pump housing wall, such as at the O-ring mentioned above but not shown, and the friction between the sealing ring 22 and the inner surface of the delivery conduit.

The upward movement of the displacement member 13 stops at the upper end position shown in FIG. 2. At that position the outlet valve 17 is closed, and as a consequence the displacement member will be subjected to a downward load from a head pressure corresponding to the height of the column of liquid in the delivery conduit 18 (more precisely, the difference in head pressure between the space 30 above the end part 12 and the inlet 21). That pressure acts on an upwardly facing thrust surface at the upper end of the piston rod 16 which corresponds to the external cross-sectional surface area C of the piston rod 16. A corresponding, downwardly facing thrust surface is constantly subjected to the lower head pressure in the inlet 21. The resulting force on the displacement member 13 tends to press the displacement member downwards.

As soon as the displacement member 13 starts to move downwards, the inlet valve 15 will open and admit water through the passage 26 into the pump chamber 24 to refill it, the pump chamber then being at virtally the same pressure as the inlet. At the same time, the liquid level in the delivery conduit 18 will be slightly lowered because the piston rod 16 is moved further downwards into the pump chamber 24.

Upon return of the displacement member 13 to the lower end position shown in FIG. 1, the above-described sequence is repeated.

If the displacement member 13 is pulled upwards beyond the normal upper end position shown in FIG. 2 so that the pump piston 14 moves above the stroke range S, the hole 32 will finally be above the internal piston rod seal 25 in the end part 12. Continued upward pull will cause the upper end of the pump piston 14 to engage the underside of the end part 12 which will be moved upwardly with the pump piston 15 as the upward pull continues.

When the sealing ring 23 of the pump piston emerges from the pump chamber wall 11, an annular passage is formed between the inner surface of the delivery conduit 18 and the pump piston 14, see FIG. 3. Water can then flow from the column of water above the raised end part 12 through the hole 32 of the pump piston rod 16 and the now fully open pump chamber 24 into the inlet 21. The water forcefully flushes the inlet valve so that dirt that has accumulated in the inlet valve is flushed away. Dirt that has collected at the upper end of the pump chamber wall 11 is also flushed away.

After the column of water has disappeared, the upward pulling of the displacement member 13 can continue without it being necessary to overcome any force in addition to the weight of the displacement member and parts associated with it, i.e. the lifting cable 20 and the protective tube 31.

After the displacement member has been inspected and cleaned, if necessary, and maintenance work, such as replacement of damaged or worn parts, or repair has been carried out, the displacement member can be reinserted in the delivery conduit 18 and lowered until the end part 12 has been brought in position in the pump chamber wall 11. If the end part 12 should stick during its downward movement in the delivery conduit, it can be loaded by an additional force by filling the delivery conduit with water from the upper end.

Figure 4:
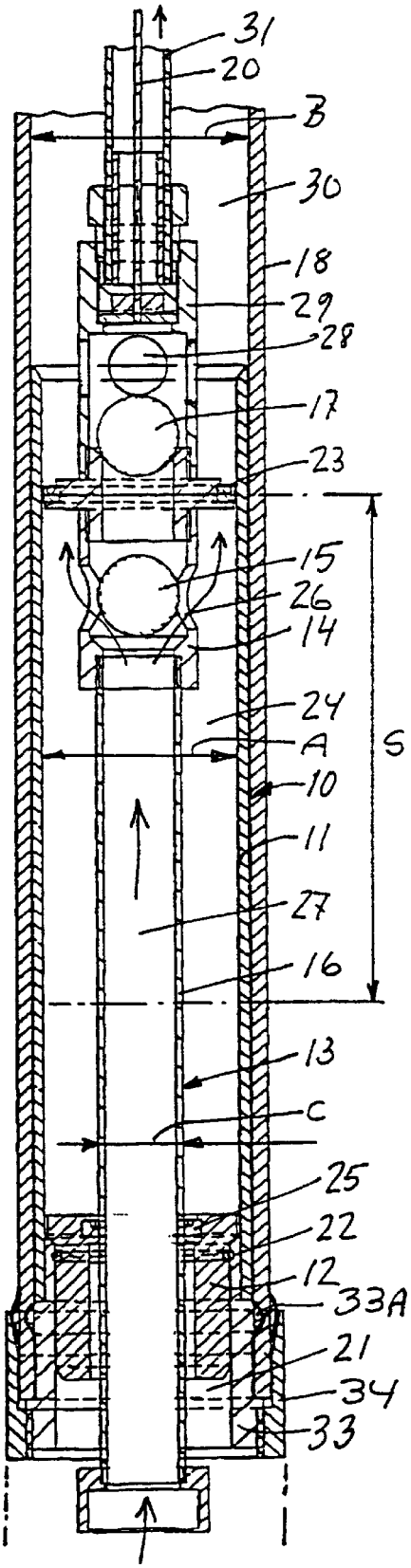
FIGS. 4 and 5 are views corresponding respectively to FIG. 1 and FIG. 2 illustrating a modified embodiment.
Figure 5:
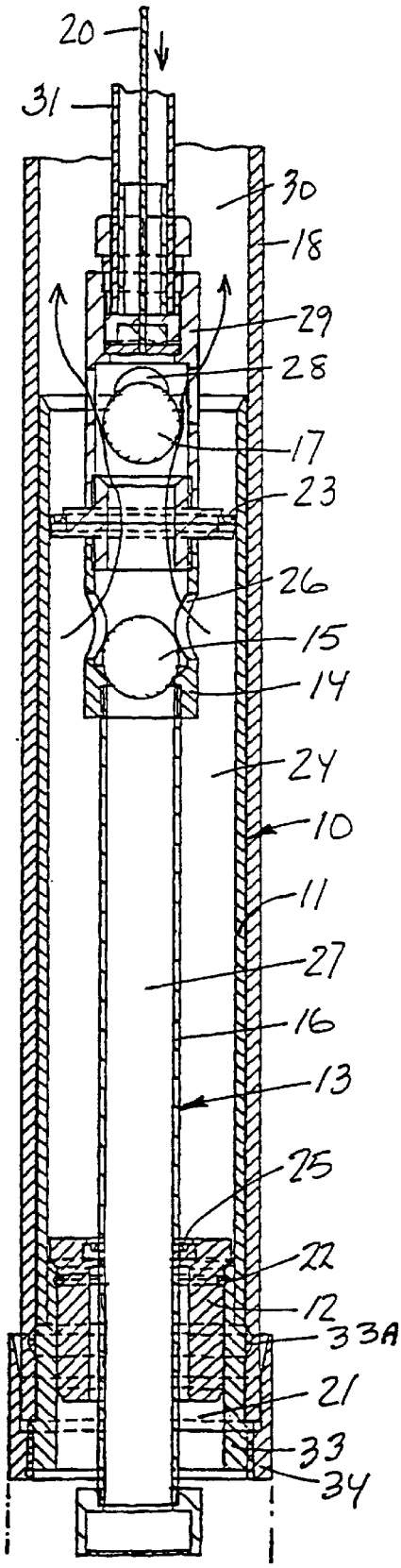

The embodiment of the pump shown in FIGS. 4 and 5 essentially corresponds to the embodiment shown in FIGS. 1 to 3 in respect of the basic structure and the operation and like reference signs are used consistently to designate corresponding parts of the two embodiments. The main difference is that while in the pump of FIGS. 1 to 3 the upper delimitation of the pump chamber 24 is formed by a stationary part, namely the end part 12, and lower one is formed by a movable part, namely the pump piston 14, the upper delimitation of the pump chamber 24 of FIGS. 4 and 5 is formed by the pump piston 14 and the lower one is formed by the end part 12.

One structural difference with respect to the embodiment of FIGS. 1 to 3 is that the pump piston 14 of the pump shown in FIGS. 4 and 5 is united with both the inlet valve 15 and the outlet valve 17.

Another structural difference is that the attachment of the end part 12 to the pump housing wall 11 is differently constructed. The lower end of the delivery conduit 18, which may be a plastic hose as in FIGS. 1 to 3, is clamped between an inner base sleeve 33, which is press fitted in the lower end of the delivery conduit and provided on its outer side with an annular bead 32A, and an outer base sleeeve 34 screwed onto the inner base sleeve.

An outer, downwardly facing annular conical surface of the end part 12 engages a complementary, upwardly facing annular conical surface on the upper end of the inner base sleeve 33. The portion of the end part 12 that is below the lastmentioned annular conical surface is sealed to the inner surface of the inner base sleeve 33 by an O-ring 22, which forms part of a snap-action coupling. This O-ring is accommodated partly in an annular groove in the inner base sleeve 33 and partly in the end part 12. Thus, the end part 12 can be pulled off upwards from its normal position in the pump housing 10 by applying an extra upward force by means of the lifting cable 20.

The outer base sleeve can be extended downwardly as indicated in dash-dot lines so that it surrounds and protects the downwardly projecting part of the piston rod 16 throughout its range of movement.

The delivery conduit 18 shown in the drawing, the internal cross-sectional area of which is slightly larger than the cross-sectional area of the pump chamber 24, in not indispensable. If desired, the delivery can take place through the protective tube 31 or another tube connected to the displacement member and having a cross-sectional surface area substantially smaller than that of the pump chamber. In that case, the outlet valve 17 is structured such that the liquid pushed upwards from the pump chamber 24 through the piston rod passage 27 is led into that tube. The anchoring of the pump housing of the lifting pump in the wellbore can be accomplished by means of a hydrostatic expander or in some other suitable way.

Use of such a delivery conduit of small diameter connected to the displacement member 13 is advantageous in that only a small number to pump strokes are required to fill the entire delivery conduit.

In both of the illustrated embodiments the cross-sectional area of the pump piston can amount to a large proportion of the internal cross-sectional area of the delivery conduit; the difference in area only corresponds to the difference between the diameters B and A, i.e. the cross-sectional area that the pump housing 10 accommodates in the delivery conduit.

The embodiment in FIGS. 4 and 5 is particularly suited if the delivery conduit 18 is a plastic hose and cannot therefore be guaranteed to have accurately circular cross-section throughout its length. In this embodiment, not only the pump piston 14, but also the end part 12, have a diameter that is equal to the diameter of the pump chamber wall 11. During the extraction of the displacement member 13 and the end part 12 from the pump housing 10, both the pump piston 14 and the end part 12 will have a clearance to the inner surface of the delivery conduit 18 which is sufficiently large to ensure that any existing non-circular portions of the delivery conduit will not interfere with the continued pulling up of the delivery conduit to the ground level.

What is claimed is:

1. A positive-displacement pump comprising a pump housing (10) with a pump chamber (24) having an inlet (21) and an outlet passage (28) controlled by a first outlet check valve (17), a displacement member (13) which delimits the pump chamber (24) in one direction of movement of the displacement member and which is reciprocable in the pump chamber within a stroke region (S) and includes a second check valve (15) opening into the pump chamber (24) and disposed in a passage (26) between the inlet and the pump chamber, and an actuating mechanism for repetitively reciprocating the displacement member (13) in the pump housing (S) within the stroke region (S), characterised in that the pump chamber (24) is limited in the opposite direction of movement of the displacement member (13) by an end part (12), which is in engagement with the pump housing (10) and drivable away from the pump housing (10) by means of the displacement member (13) upon movement of the displacement member beyond the stroke region (S).

2. A positive-displacement pump as claimed in claim 1, characterized in that the displacement member (13) has an upper thrust surface, which is constantly subjected to the pressure in the outlet passage (28) during the movement of the displacement member within the stroke region (S), and a corresponding lower thrust surface, which is constantly subjected to the pressure in the inlet (21) during the movement of the displacement member within the stroke region (S) so that the displacement member (13) is subjected to a resulting vertical thrust force when the pressures in the inlet and the outlet are dissimilar.

3. A positive-displacement pump as claimed in claim 1 or 2, characterised in that the displacement member (13) includes a pump piston (14) and a piston rod (16) which is attached to the pump piston and protrudes from the pump chamber (24).

4. A positive-displacement pump as claimed in claim 3, characterised in that the piston rod (16) extends through the end part (12).

5. A positive-displacement pump as claimed in claim 1 or 2, characterised in that both the first valve (17) and the second valve (15) are provided on the displacement member (13).

6. A positive-displacement pump as claimed in claim 1 or 2, characterised in that the first valve (17) and the second valve (15) are ball valves or cone valves.

7. A positive-displacement pump as claimed in claim 1 or 2, characterised in that the pump housing (19) includes a side wall (11) formed by a circular cylindrical tube.

8. A positive-displacement pump as claimed in claim 1 or 2, characterised in that the pump housing (10) includes a side wall (11) which is fixedly secured in a delivery conduit (18).

9. A positive-displacement pump as claimed in claim 1 or 2, characterised by a delivery conduit (18) formed by a flexible tube in which the pump housing is inserted and secured.

10. A positive-displacement pump as claimed in claim 1 or 2, characterised in that the actuating mechanism includes a lifting cable (20) connected to the displacement member.

* * * * *